United States Patent [19]

Gomez

[11] Patent Number: 4,762,327

[45] Date of Patent: Aug. 9, 1988

[54] GAME TABLE

[76] Inventor: Sergio Gomez, 9710 SW. 103 Ave., Miami, Fla. 33176

[21] Appl. No.: 20,898

[22] Filed: Mar. 2, 1987

[51] Int. Cl.[4] ..... A63F 9/00; F25D 23/12

[52] U.S. Cl. ..... 273/309; 62/258; 108/50; 211/59.2

[58] Field of Search ..... 273/309; 62/258; 108/25, 50; 211/59.2

[56] References Cited

U.S. PATENT DOCUMENTS

| | | | |
|---|---|---|---|
| Re. 12,477 | 5/1906 | Hecker | 62/258 |
| 1,840,645 | 1/1932 | Tibbot | 62/258 |
| 2,627,445 | 2/1953 | Lyon | 62/258 |
| 3,364,882 | 1/1968 | Merrick | 108/25 |
| 4,228,903 | 10/1980 | Eckert | 211/59.2 |

*Primary Examiner*—Anton O. Oechsle
*Attorney, Agent, or Firm*—Jesus Sanchelima

[57] ABSTRACT

A game table that includes a refrigerating unit and at least one compartment for storing foodstuffs and drinks at low temperature and within the easy reach of the users. Spring supported platforms are conveniently distributed over the table's top surface allowing the drink containers to sink inside the refrigerated compartment. Flat gameboards of varying designs are removably mounted on the center of the top surface of the table sealing the refrigerating compartment and allowing the placing of foodstuff and containers inside the compartment. Cans are placed on inclined planes that allow them to roll towards outlet gates for their retrieval.

5 Claims, 1 Drawing Sheet

GAME TABLE

BACKGROUND OF THE INVENTION

1. Field of the Invention

The present invention relates to game tables, and more particularly, to such tables that include refrigerating means to maintain foodstuff and drinks cold for the users.

2. Description of the Related Art

A number of tables have been designed in the past to accomplish a variety of purposes. In particular, a table is disclosed in U.S. Pat. No. 3,364,882, issued to B. P. Merrick, which applicant believes to be the closest prior art. Merrick's table teaches the use of a cooler for leaf-type tables. A user has to replenish the ice periodically if he wants to maintain his drinks cold. Merrick's design is intended to be used for a few hours, then the foodstuff and drinks removed and a panel placed to cover the space.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a game table that is capable of storing foodstuff and drinks at low temperatures.

It is another object of this present invention to provide a game table specially adapted to maintain the user's drinks cold while they are being consumed.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
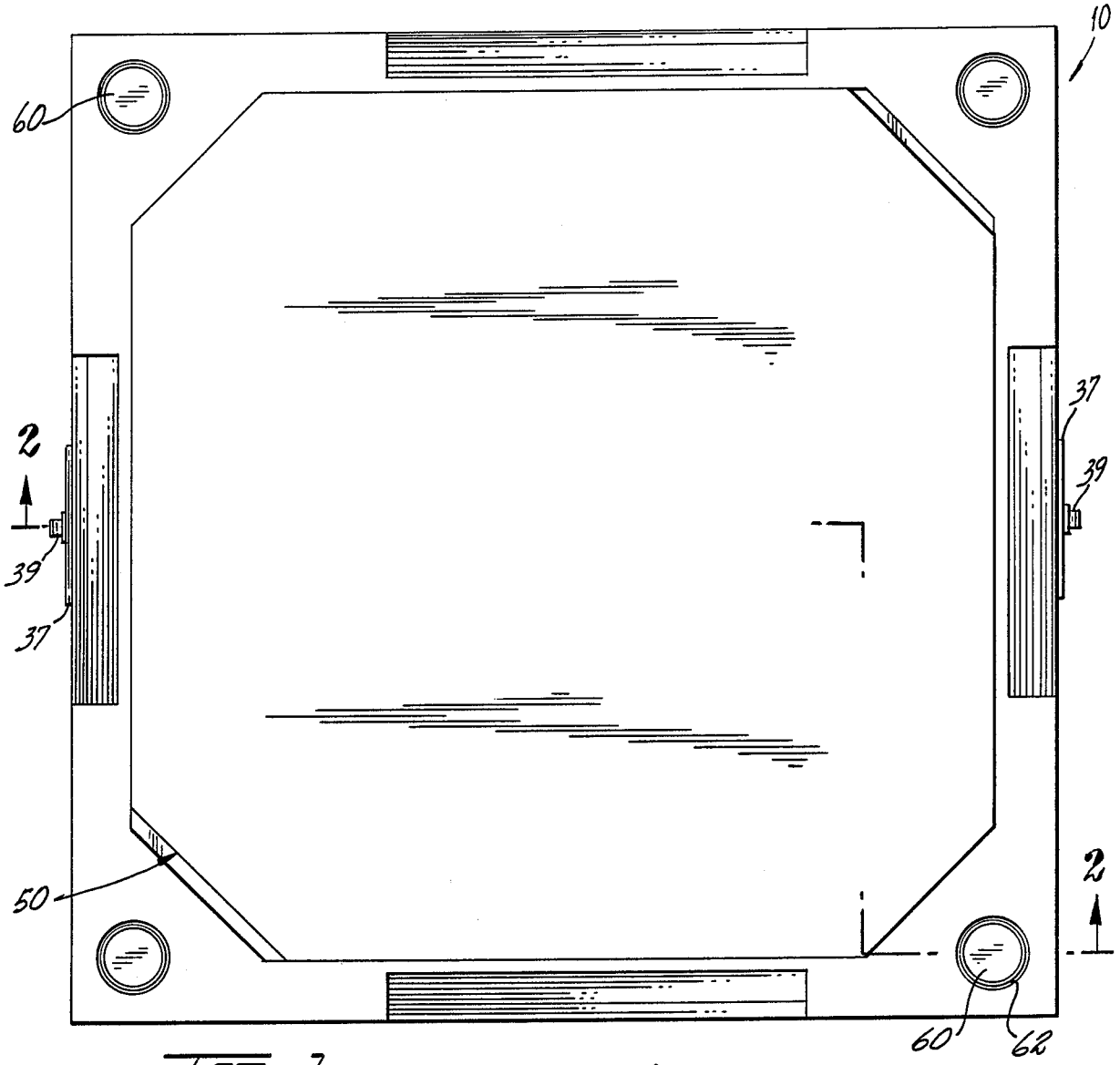
FIG. 1 represents a top view of the game table.
Figure 2:
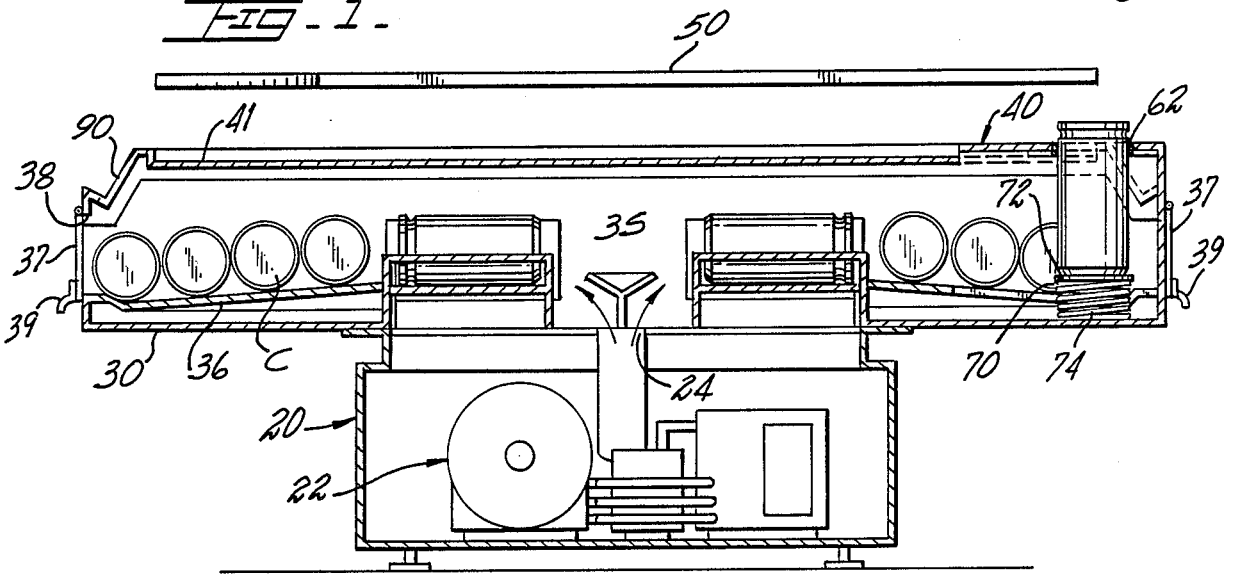
FIG. 2 shows a cross-sectional view of the table shown in FIG. 1 taken along line 2—2.

Referring now to FIGS. 1 and 2, where the present invention is generally referred to with numeral 10, it can be observed that it, basically, includes a base member 20, a refrigerated compartment box 30 and a top member 40.

In FIG. 2 it can be seen that base member 20 houses, in the preferred embodiment, a refrigeration unit 22, of conventional construction, that blows cool air through grill 24 to compartment 35. Compartment 35 is defined by box 30 and top member 40 and it is thermically sealed in order to prevent any leakage of heat from the outside. Preferably, top member 40 is removably mounted over box member 30 in order to provide easy access to compartment 35, if needed, for cleaning and maintenance. Top member 40 provides a recessed top surface 41, preferably at the center, over which a flat overlay 50 (that may include a gameboard design such as a chessboard or any other gameboard design) is removably mounted. Overlay member 50 is preferably made out of a plastic transparent material (plexi-glass) and it is slightly smaller than recessed top surface 41 in at least one of its sides or corners in order to facilitate its removal. It may also be possible to provide an opening (not shown) on top member 40 which is sealably covered with overlay 50 so that easy access is provided to compartment 35. Inside box 30, several ramps 36 are mounted over the bottom member 32 so that conventional soda or beer cans C can roll down outwardly through conveniently located outlet gates 38. To replenish the cans, they are pushed in through gate 38. Other spaces of compartment 35 may be used to store sandwiches or other foodstuffs. Gates 38 are sealably covered with hingedly mounted covers 37. Preferably, covers 37 are spring loaded urging them towards apertures 38 preventing thermic leakage. A handle member 39 is provided to facilitate lifting cover 37.

Several round apertures 60 are provided on top member 40, preferably one on each corner, with a diameter that is slightly larger than the conventional diameter of soda or beer cans C. A peripheral foam seal 62 is provided on the internal surface of each aperture 60 to prevent any excessive thermal leakage. Foam seal 62 conforms to the contour of the lateral walls of conventional cans. A spring loaded platform assembly 70 supports can C. Assembly 70 includes a platform member 72 of dimensions somewhat larger than apertures 60 so that the latter are closed with members 72 when there are no cans C on them and spring member 74 is in distension. The more liquid cans C have, the greater the compression on spring member 74, making cans C to sink deeper and, consequently, a larger area of the can is exposed to cold compartment 35 thereby efficiently maintaining cans C cold.

Top member 40 has, in the preferred embodiment one inclined recessed portion 90 positioned in front of each player. Portion 90 extends horizontally and has sufficient width to provide the necessary structural support for cards, dominoes and other tokens commonly used in games thereby freeing up the players' hands.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A table for playing games and storing beverage containers and foodstuffs, comprising:

A. a base member;

B. refrigerating means housed within said base member;

C. a thermically sealed compartment connected to said refrigerating means and including at least one gate and said compartment includes at least one inclined plane for each of said gates so that said beverage containers with cylindrical shape may be cooperatively placed on said inclined plane and urged by gravity towards said gate, and further including cover means for said gates; and D. a top member mounted over said compartment wherein said top member includes at least one aperture that connects with said compartment and said compartment including a spring loaded platform located directly below said aperture and so arranged and constructed that said aperture is of sufficiently large dimensions to allow said containers through to rest on said platform and said platform is pushed down proportionately to the weight of the liquid in said container.

2. The game table set forth in claim 1 wherein said apertures include a peripheral foam seal mounted on the internal surface of said apertures.

3. The game table set forth in claim 2 wherein said top member includes a recessed portion.

4. The game table set forth in claim 3 further including at least one overlay means removably mounted over said top member.

5. The game table set forth in claim 4 wherein said top member includes at least one opening connected to said compartment so that easy access to said compartment is provided.

* * * * *